United States Patent [19]

Lavery et al.

[11] 4,326,646

[45] Apr. 27, 1982

[54] AUTOMATIC DEVELOPMENT DISPENSER CONTROL

[75] Inventors: Lawrence P. Lavery, Fairport; David G. Wilcox, Macedon; Dale C. Thomas, Ontario, all of N.Y.

[73] Assignee: Xerox Corporation, Stamford, Conn.

[21] Appl. No.: 38,371

[22] Filed: May 11, 1979

[51] Int. Cl.[3] ..... B67D 5/08

[52] U.S. Cl. ..... 222/56; 222/DIG. 1; 118/691; 355/14 C

[58] Field of Search ..... 222/52, 55, 56, DIG. 1; 118/691; 355/3 DD, 14

[56] References Cited

U.S. PATENT DOCUMENTS

| | | | |
|---|---|---|---|
| 4,032,227 | 6/1977 | Hubbard et al. | 222/DIG. 1 |
| 4,065,031 | 12/1977 | Wiggins et al. | 222/DIG. 1 |
| 4,108,545 | 8/1978 | Eckert et al. | 222/DIG. 1 |

OTHER PUBLICATIONS

Smith; "Toner concentration control", 4-77, p. 4078, IBM Technical Disclosure Bulletin, vol. 19, No. 11.

*Primary Examiner*—Joseph J. Rolla
*Attorney, Agent, or Firm*—Ronald F. Chapuran

[57] ABSTRACT

An automatic development control system having a sensor providing a signal representative of developed toner mass on a patch sample on the photoreceptor. The signal is conveyed to a comparator through signal processing circuits for comparing with a reference signal. The signal processing circuits include digital to analog circuitry also capable of providing analog to digital conversion. The reference signal represents an undeveloped photoreceptor signal normalized to accommodate changing photoreceptor, sensor and operating environment characteristics. A dispenser solenoid activates a toner dispenser through an interrupt mechanism in given increments of time depending upon the error signals generated by the comparator.

14 Claims, 8 Drawing Figures

AUTOMATIC DEVELOPMENT DISPENSER CONTROL

This invention relates to electrophotographic toner dispensing devices and in particular to the automatic control of these devices.

In electrophotographic apparatus, an electrostatic image, formed on the surface of a drum or web, is developed by the application of finely divided toner particles to form a toner image. In certain electrophotographic apparatus, toner images are formed from electrostatic images by brushing a developer mixture of ferromagnetic carrier particles and smaller toner particles across the electrostatic images. The contact of the ferromagnetic particles with the toner particles charges the toner particles by triboelectrification to a polarity needed in order that the toner particles are attracted to the electrostatic images for toning.

In this process, toner particles are depleted from the developer mixture, requiring replenishment to avoid a gradual reduction in density of the toner images. Toner replenishment is accomplished by several different types of apparatus. In one type, a given amount of toner is added to the mixture after a given number of copies is made. This approach is acceptable if the amount of toner used for each copy is reasonably predictable. In some apparatus, however, the amount of toner used in any copy or group of copies can vary substantially. For this reason, toner concentration monitors have been designed which automatically add toner according to the results of a monitoring process.

U.S. Pat. No. 2,956,487 generally shows the use of control signals to activate a vibrator to add developer particle powders from a reservoir to a magnetic brush trough. U.S. Pat. Nos. 3,348,522, 3,348,523 and 3,376,853 disclose a reflective type sensor for use in closed loop automatic development control. A clean drum signal is compared to a signal reflected from a test pattern formed on the drum. Separate sensors are utilized for detecting each signal. The outputs of the sensors are compared by a bridge circuit to provide an error signal, and a toner dispenser is operated in response to the error signal. In these systems, the degree of development is measured directly from a developed test stripe on the photoreceptor drum extending along the peripheral edge of the drum.

In systems such as shown in U.S. Pat. Nos. 3,873,002 and 4,065,031, an electrically biased transparent electrode disposed on the photoreceptor surface is conveyed past the development station to attract toner particles. Light is transmitted from within the photoreceptor through the transparent electrode and detected by a photosensor located near the photoreceptor surface. The photosensor provides a signal indicative of the density of toner particles on the transparent electrode. A disadvantage with systems of this type is the relative cost due to the complexity and number of components required.

Other systems control toner dispensers by measuring toner concentration in the developer mixture contained in a developer housing or reservoir. For example, U.S. Pat. No. 3,233,781 discloses reflecting a light beam from the developer mixture. The measure of the reflectivity of the mixture manifests the proportion of toner to carrier concentration in the mixture. Disadvantages with systems of this type are due in part to "noise" generated in the system, to the fact that the system is only an analog of the amount of toner actually applied to the photoreceptor surface, and to the dependance of the system to the constituents of the developer mixture.

Other examples of analog control are U.S. Pat. No. 3,968,926 teaching the use of a funnel in the developer apparatus to collect developing material. An inductance coil is wound about the funnel and connected to the motor of a toner dispenser through a bridge circuit. The reactance of the inductance coil varies in accordance to percentage of toner contained in the developing material. Other systems such as disclosed in U.S. Pat. No. 3,719,165 control a toner replenisher by measuring the electric potential of a magnetic developing brush. In U.S. Pat. No. 3,876,106, light is reflected from a development brush to measure the concentration of toner in the developer housing. The reflective signal is fed to a computer and the computer determines whether or not the toner could be added and controls a toner replenishment device accordingly. In other approaches to improve toning, often referred to as "Auto-Bias", the potential of an electrode in the development station is adjusted as a function of the charge density of the electrostatic image. See, for example, U.S. Pat. No. 3,779,204 teaching the use of an electrometer probe disposed near a photoreceptor belt to provide "Auto-Bias" and also to produce a signal to actuate a toner dispenser through threshold circuitry.

The difficulty with many of the aforementioned automatic development control systems is often the difficulty in compensating for a variety of changing characteristics such as the changing characteristics of a photoreceptor surface, the changing characteristics of the documents to be copied, and even the changing characteristics of the toner dispenser itself. In addition, prior art systems often do not monitor the amount of toner mass developed on the photoreceptor surface and do not accurately compensate for sensed toner deficiencies.

It would be desirable, therefore, to provide an economical and flexible automatic development control system responsive to various changing characteristics in the development cycle and that can accurately respond to signals representing developed toner mass.

It is therefore an object of the present invention to improve development control by automatically activating a toner dispenser in response to changing characteristics of elements in the development cycle and in response to signals representing developed toner mass.

Further advantages of the present invention will become apparent as the following description proceeds, and the features characterizing the invention will be pointed out with particularity in the claims annexed to and forming a part of this specification.

Briefly, the present invention is concerned with an automatic development control having a sensor providing a signal representative of developed toner mass on a patch sample on the photoreceptor. The signal is conveyed to a comparator through signal processing circuits for comparing with a reference signal. The reference signal represents an undeveloped or bare photoreceptor signal normalized to accommodate changing photoreceptor, sensor and operating environment characteristics. A dispenser solenoid activates a toner dispenser through an interrupt mechanism in given increments of time depending upon the error signals generated by the comparator. In a preferred machine having a two second copy cycle, the toner dispenser is not activated or activated 0.5, 1.0 and 1.5 seconds in response to the sequence of error signals generated. The signal processing circuits include digital to analog circuitry also capable of providing analog to digital conversion.

For a better understanding of the present invention, reference may be had to the accompanying drawings wherein the same reference numerals have been applied to like parts and wherein.

Figure 2:
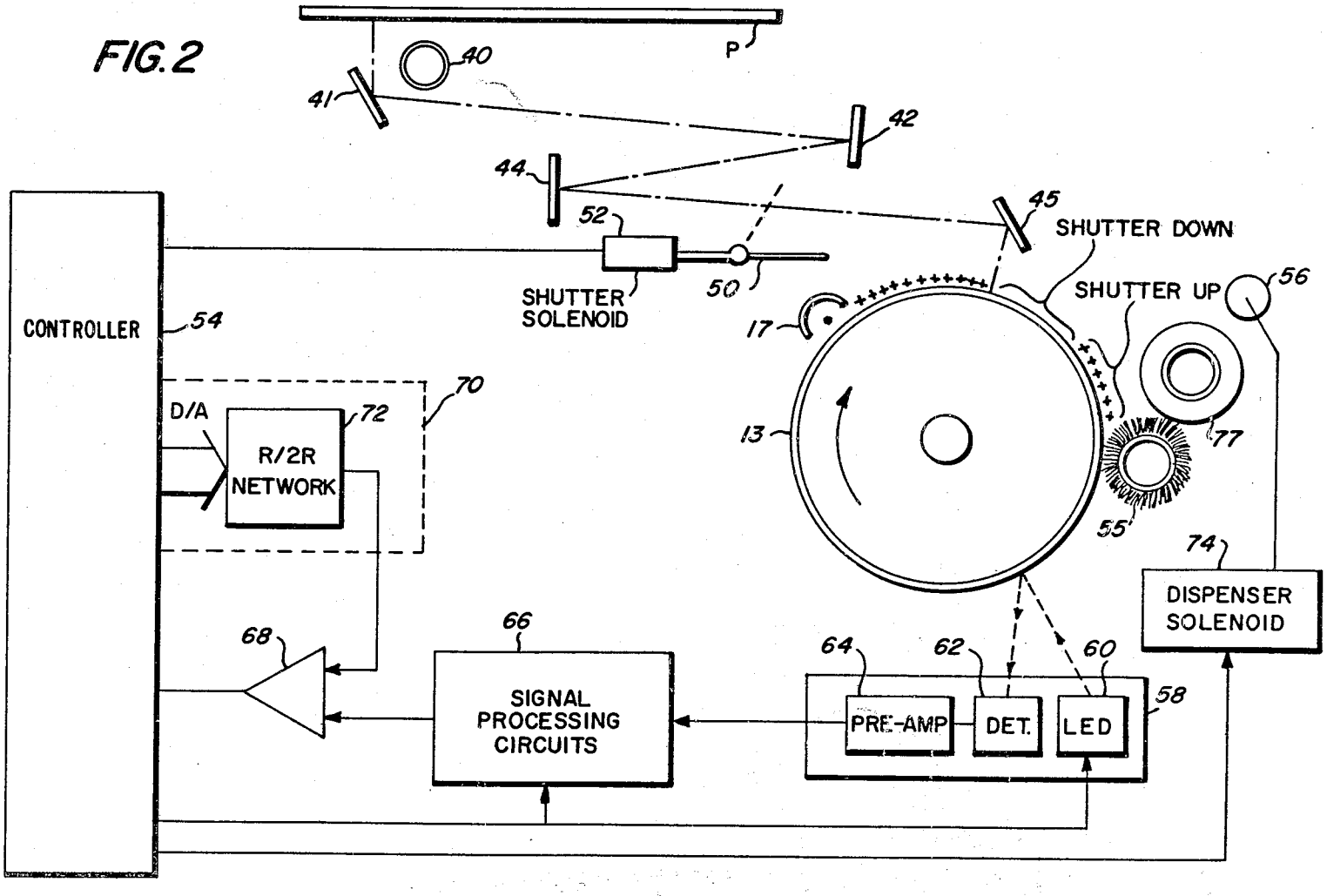
FIG. 2 is a schematic block diagram illustrating the automatic development control system in accordance with the present invention.
Figure 4A:
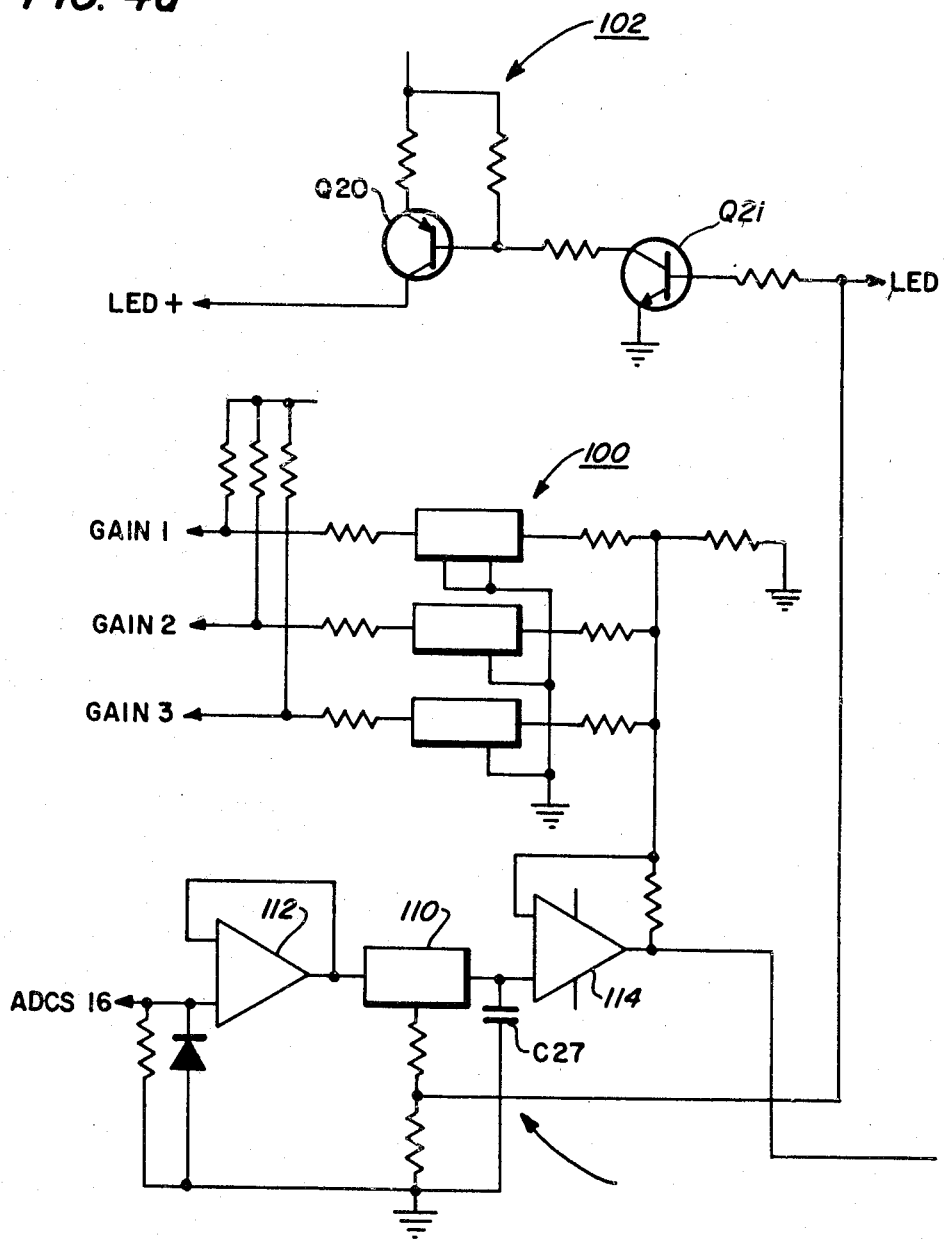
Figure 4B:
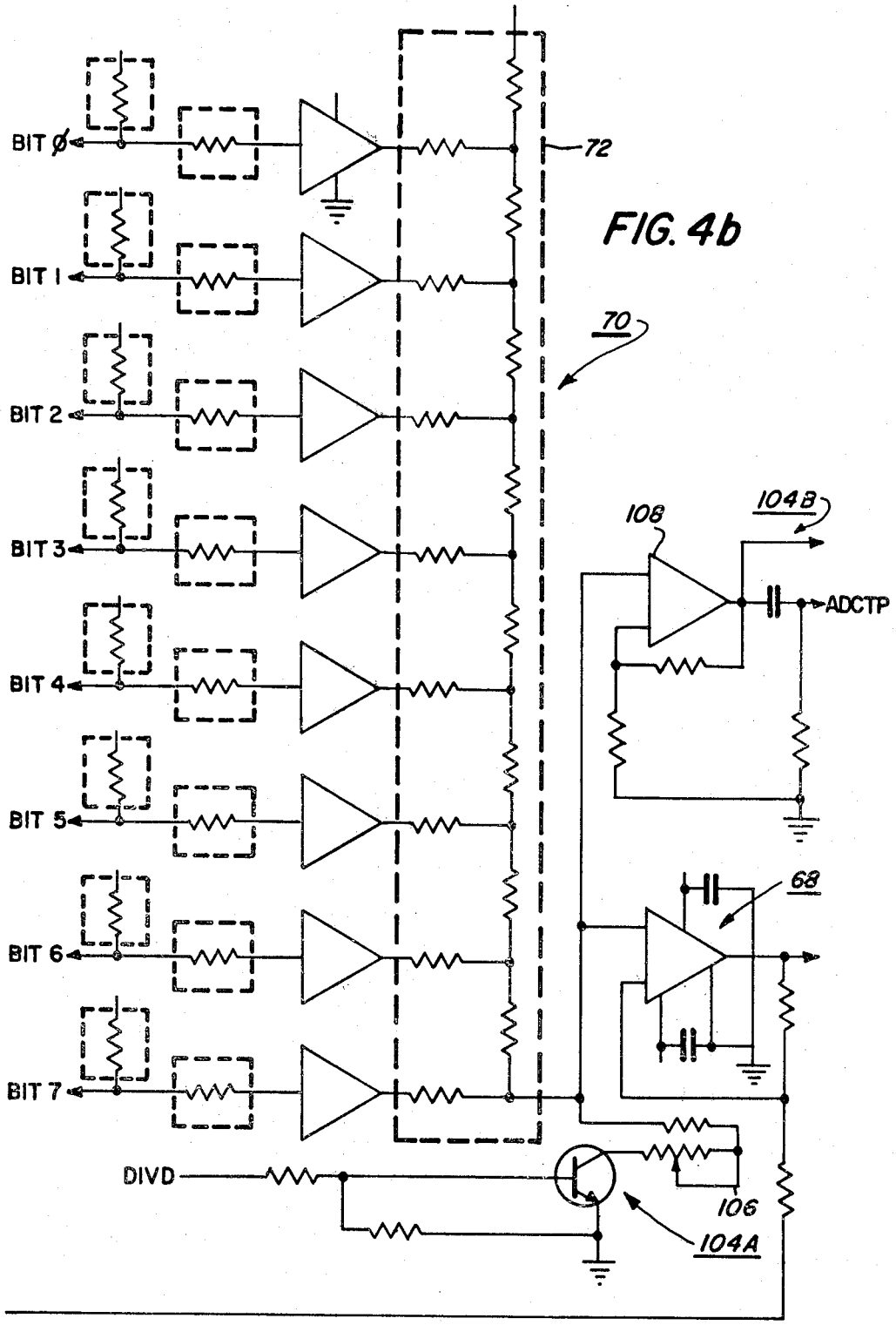
Figure 5:
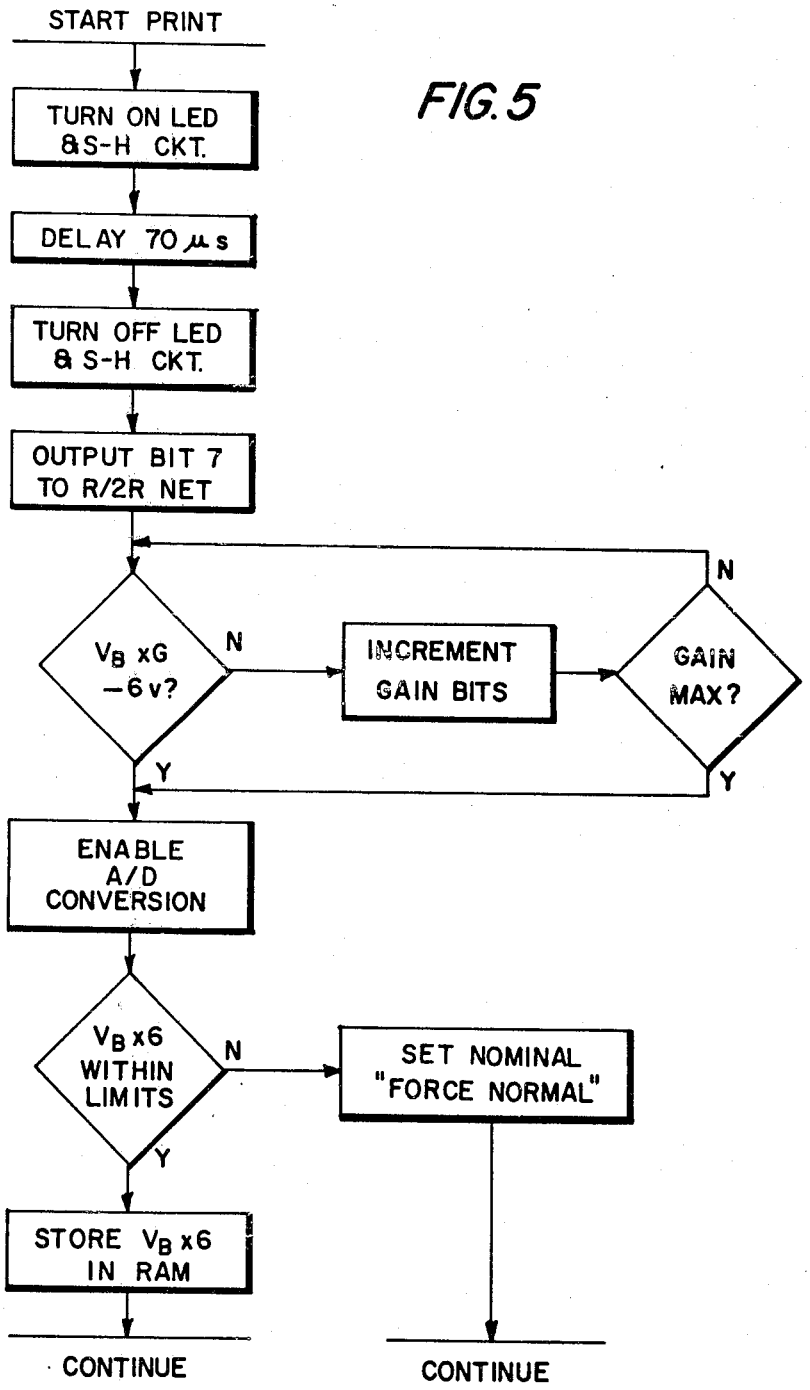
Figure 6:
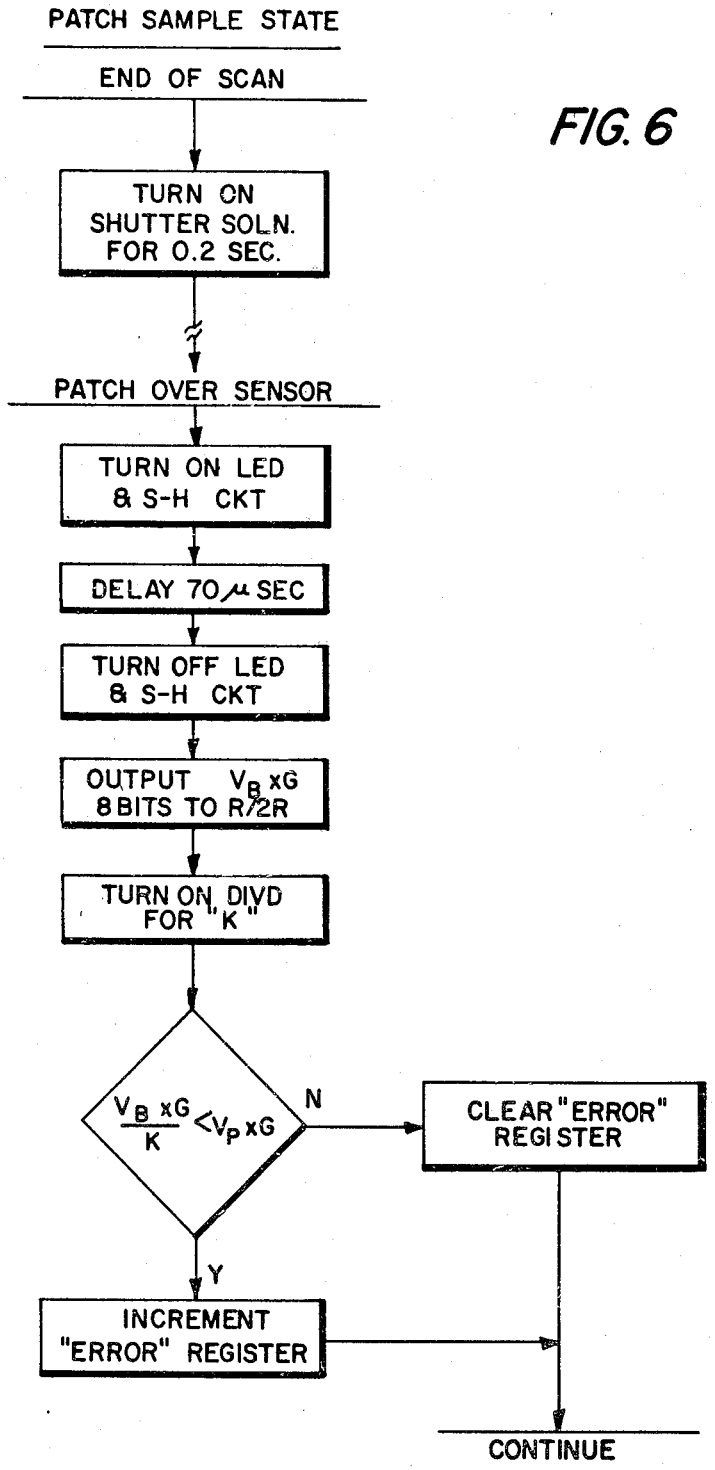

FIGS. 4*a* and 4*b* are a circuit diagram of the signal processing circuits, the comparator, and the digital to analog converter shown in FIG. 2 in addition to LED driver and manual adjust circuitry;

FIG. 5 is a flow chart of the background sample state;

FIG. 6 is a flow chart of the patch sample state; and

Figure 7:
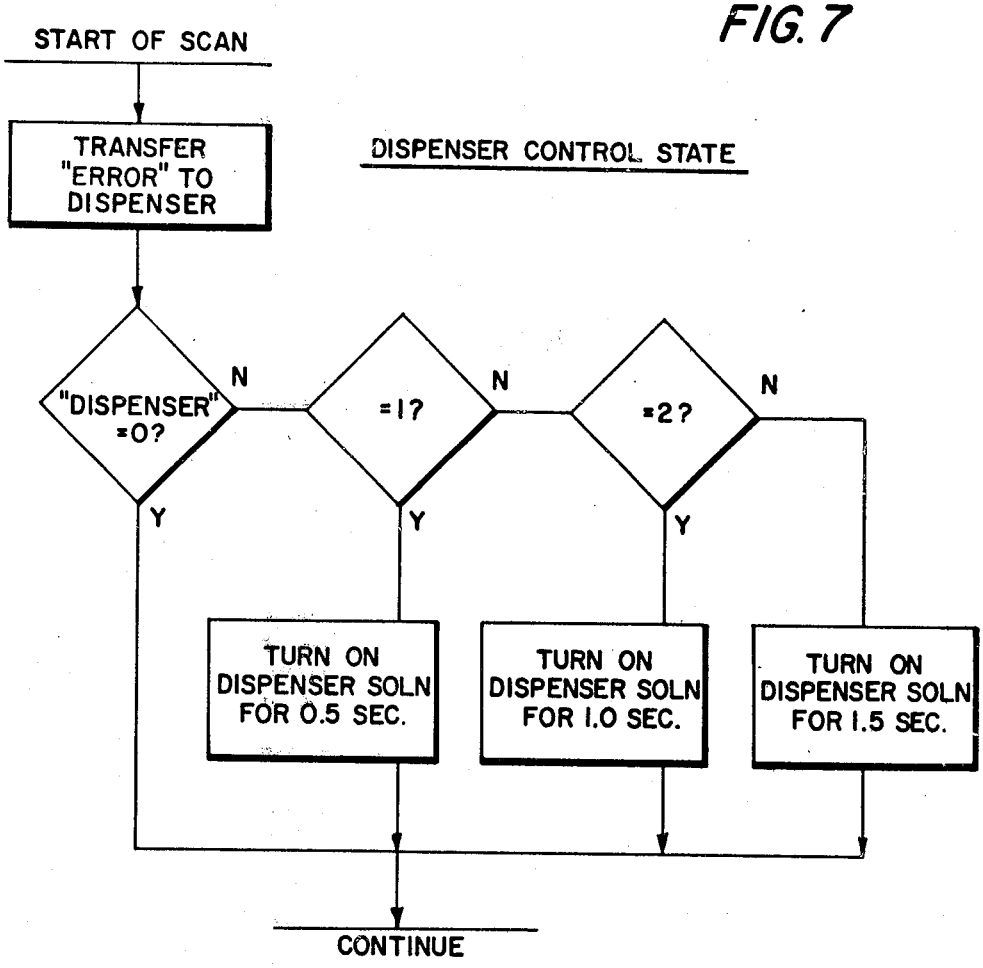

FIG. 7 is a flow chart of the toner dispenser state.

DESCRIPTION OF PREFERRED EMBODIMENT

Figure 1:
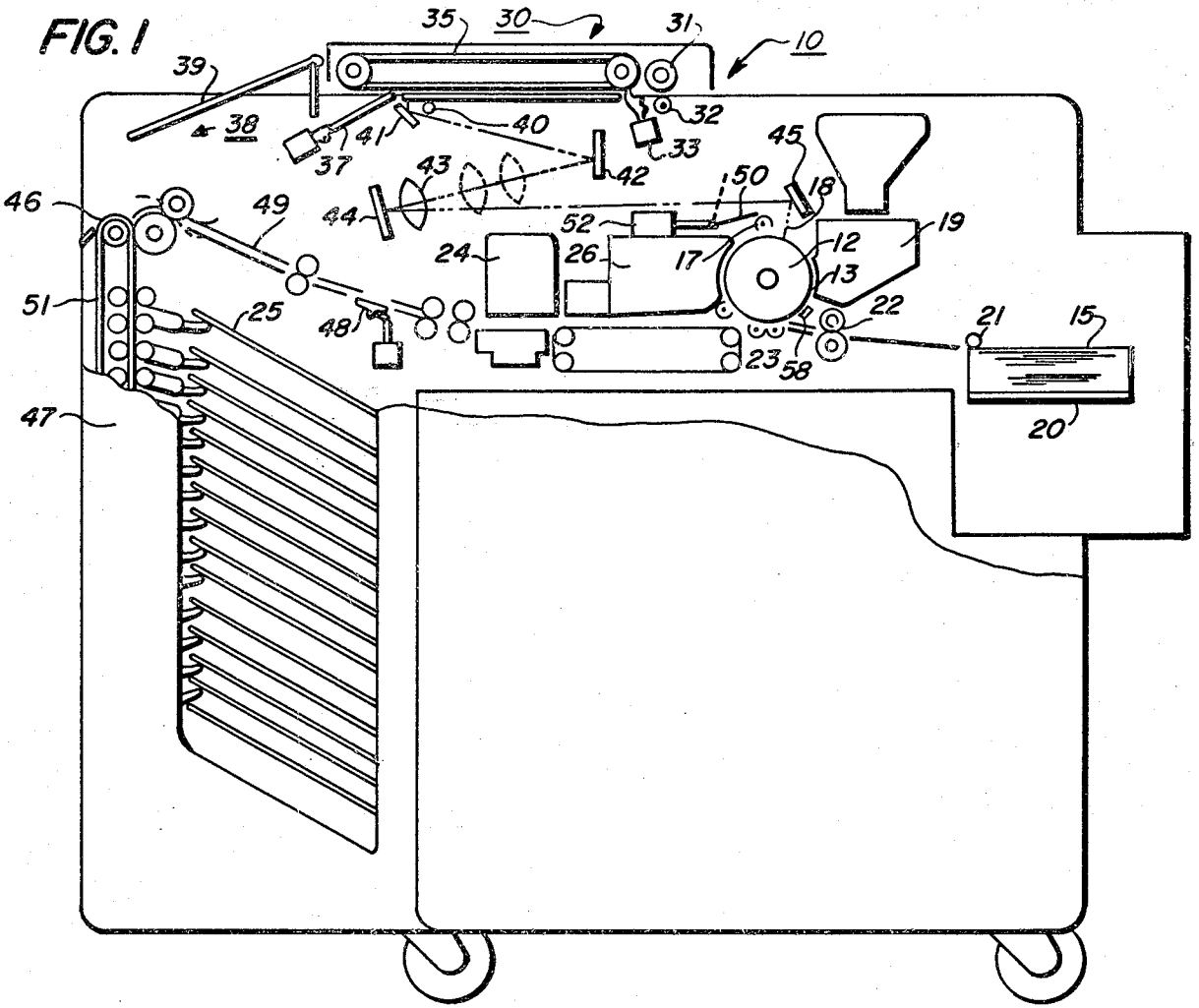
FIG. 1 is a front view of a reproduction machine incorporating the present invention.

Referring to FIG. 1 there is shown a reproducing machine 10 employing an image recording drum 12 having the outer periphery coated with a suitable photoconductive material providing an image bearing surface 13. The drum 12 is suitably journaled for rotation within a machine frame (not shown) by means of a shaft and rotates in the clockwise direction to bring the image-bearing surface past a plurality of machine components or xerographic processing stations. Suitable drive means (not shown) are provided to power and coordinate the motion of various machine components to produce a faithful reproduction or image of an original document upon a sheet of final support material.

Initially, the drum 12 moves the surface 13 through a charging station 17 for placing an electrostatic charge over the surface 13 in known manner preparatory to imaging. Thereafter, the drum 12 is rotated to exposure station 18 and the charged surface 13 is exposed to a light image of an original document supported at platen P. The document image selectively dissipates charged surface 13 to form an electrostatic latent image. After exposure, drum 12 rotates the electrostatic latent image recorded on the surface 13 to development station 19 and a conventional developer mix including toner and carrier particles is supplied to the surface 13 rendering the latent image visible.

Sheets 15 of the final support material are supported in a stack arrangement on an elevating stack support tray 20. With the stack at its elevated position, a sheet separator 21 feeds individual sheets to a registration device 22. The sheet is then forwarded from registration device 22 to a transfer station 23 in proper registration with the image on the drum. The developed image on the surface 13 is brought into contact with the sheet of final support material within the transfer station 23 and the developed image is transferred from the surface 13 to the contacting side of the support sheet.

After the developed image has been transferred to the sheet of final support material 15, the sheet with the developed image is advanced to a suitable fuser 24. The fuser 24 coalesces the transferred image to the final support sheet 15. After the fusing process, the final support sheet is advanced to a suitable output device such as tray 25.

Although a preponderance of the toner particles are transferred to the final support material, invariably some residual particles remain on the surface 13 after transfer. The residual particles remaining on the surface 13 are removed from the drum 12 by a cleaning station 26. The particles may be mechanically cleaned from the surface 13 by any conventional means as, for example, by the use of a cleaning blade.

Documents are presented for exposure by a document handler 30 including an input transport comprised of input pinch rolls 31 and 32, selectively disengageable in order that a document maybe readily placed between them. The document handler 30 also includes a wait station 33 and a not shown pivotally supported registration gate for pre-registering the document and also a platen belt transport 35 and registration gate 37 provided at the distal end of platen P.

The document is driven by the belt 36 against the gate 37 in order to properly position the document on the platen for imaging. During the imaging cycle, the registration gate 37 is retracted. After imaging the document is advanced off the platen P to output tray 38 by means of the belt transport 35. Document decelerators 39 associated with the output tray 38 act upon the document as it enters the output tray 38 to properly stack the documents.

The document handling system is actuated by a number of sensors. A lever actuated switch (not shown) is positioned just ahead of the nip of the input pinch rolls 31 and 32 and serves to condition the machine for operation in a document handling mode. An input sensor (not shown) preferably comprising a photocell, is arranged to sense proper corner registration of the document at the wait station 33. In operation, the document handling system is activated by inserting a document to the wait station 33. This actuates the mode switch and in turn activates the input sensor and signals the logic (not shown) of the machine that a document handling system copy is desired.

A document positioned on platen P is scanned by a lamp 40 moving from left to right together with a full rate mirror 41 and half rate mirror 42. The image of the scanned document is projected from full rate mirror 41 to half rate mirror 42 to lens 43. The image is projected from a lens reflection mirror 44 back through the lens 43 to stationary mirror 45 and reflected from stationary mirror 45 to drum surface 13.

Still referring to FIG. 1, a copy output station generally shown at 47 is arranged adjacent the output of the fuser 24. As a sheet 15 exits from the fuser 24, it is carried by output rolls along a sorter transport 49. A deflection gate or pivoting chute 48 is arranged to selectively deflect the sheet 16 from the sorter transport 49 into the output tray 25 or to allow its continued advancement along the horizontal transport. When the chute 48 is in the up position, the sheet 15 falls into the output tray 25. When the chute is in the down position, the sheet 15 is directed forward along the sorter transport 49 to the sorter bins via vertical transport 51.

With reference to FIGS. 1 and 2, a shutter 50 upon activation by shutter solenoid 52 is mechanically positioned in the optical path to block light from a portion of the drum surface 13 in the interdocument space. The interdocument space is defined as that portion of the drum surface 13 separating successive document images projected onto surface 13. The shutter solenoid 52 receives appropriate signals from controller 54 for insertion of shutter 50 into the optical path between mirrors 44 and 45 or retraction of shutter 50 from the optical path during projection of an image of a document onto the surface 13. For a more complete description of controller 54, reference is made to U.S. Pat. No. 4,133,611 incorporated herein.

During projection of a document image onto the drum surface 13, portions of the surface 13 will be discharged corresponding to the image. This is illustrated as the shutter down area on the surface 13, as seen in FIG. 2. The shutter up or patch sample area on the surface 13, not drawn to scale for illustrative purposes, shows a high positive charge remaining on the surface 13 due to the shutter 50 preventing light from striking a portion of surface 13 in the interdocument space.

Both the shutter up and shutter down areas of the surface 13, corresponding to document imaging and a portion of interdocument space respectively, rotate to the development station 19 and receive toner from magnetic brush developer 55 in combination with dispenser roll or toner dispenser 56. A sensor 58 located near drum 12 between development station 19 and transfer station 23 senses the degree or quantity of toner on a selected portion of drum surface 13. In particular, sensor 58 is activated to sense the degree of development of a portion of surface 13 in the interdocument space defined as the patch sample area.

Sensor 58 includes a housing having a light emitting diode (LED) 60, receiving an activating pulse from the controller 54. The light from LED 60 is reflected from the patch sample area on the surface 13 and received by a detector 62. The signal from the detector 62 manifesting the quantity of toner on the developed patch, is amplified in pre-amplifier 64 and enters the signal processing circuits 66. The output signal from the signal processing circuits 66 is one of the inputs to a comparator 68. The other input to the comparator 68 is from a digital to analog, analog to digital converter D/A 70 shown in phantom, in particular, from R/2R ladder network 72. The output from the comparator 68 is input to the controller 54 and depending upon the error signal generated by the comparator 68, the controller 54 will energize dispenser solenoid 74 to activate the toner dispenser 56.

In accordance with the present invention, as illustrated in FIG. 2, there is an automatic development control loop comprising sensor 58 providing an input signal to comparator 68, an error signal generated by comparator 68, and an energizing signal provided by controller 54 to vary the time period of activation of toner dispenser 56. The time period is duty cycle related. That is, the time of activation is a predetermined percentage of the machine copy cycle time. This will become apparent as the description proceeds.

The sensor 58, initially activated by the controller 54, measures the grams per square centimeters of toner particles on the patch sample area as manifested by an electrical signal received by the sample and hold circuitry 66. The second input to the comparator 68 is a reference signal, originating as a digital signal in the controller 54 and provided through the D/A circuitry 70. Responsive to the error signal generated by the comparator 54, the controller 54 produces a signal to activate solenoid 74 to control toner dispenser 56. The toner dispenser 56 adds toner to the magnetic brush developer 55 as will become apparent to change the quantity of toner particles added to drum surface 13.

Figure 3:
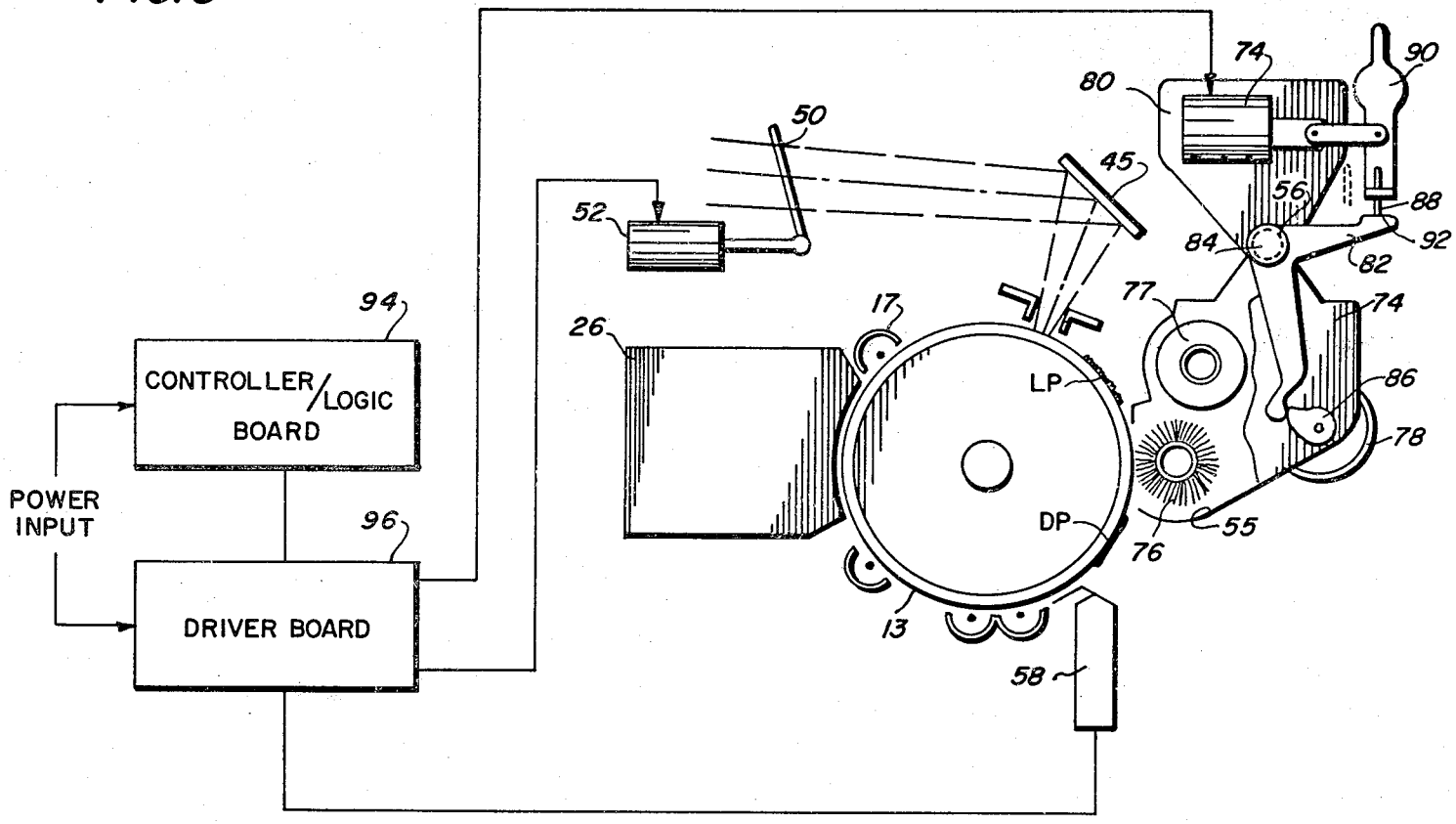
FIG. 3 illustrates the toner dispenser mechanism in accordance with the present invention.

Referring to FIG. 3, the magnetic brush developer 55 is provided in a developer housing 75 at the developing station 19. The rear of the housing 75 forms a sump containing a supply of developing material. A (not shown) passive crossmixer in the sump area serves to mix the developing material and a transport roll 77 lifts the material to the top of the housing 75.

As will be understood by those skilled in the art, the electrostatically attractable developing material commonly used in magnetic brush developing apparatus comprises a pigmented resinous powder, referred to as toner, and larger granular beads referred to as carrier. To provide the necessary magnetic properties, the carrier is comprised of a magnetizable material such as steel. By virtue of the magnetic field established by the magnetic brush developer 55, a blanket of developing material is formed along the surface of the magnetic brush developer 55 adjacent the drum surface 13. Toner is attracted to the electrostatic latent image from the carrier beads to produce a visible powder image on the drum surface 13.

Magnetic brush developer 55 comprises a rotatable exterior sleeve and a relatively stationary magnet disposed within the interior of the exterior sleeve. The sleeve is rotated with respect to the drum surface 13 by the housing drive 78. In a preferred embodiment, housing drive 78 is a gear connected to the machine 10 main drive through a suitable clutch. To regulate development of the latent electrostatic image on the drum surface 13, the exterior sleeve is electrically biased by a suitable (not shown) power supply.

In accordance with the present invention, the optimum proportion of toner to carrier material is provided by sensing the toner mass on a developed patch DP by means of sensor 58 and producing an error signal. The developed patch DP corresponds to the shutter up patch sample area of FIG. 2. The error signal generated by comparator 68 determines the time period of activation of the dispenser roll or toner dispenser 56 through dispenser solenoid 74 to control the amount of toner to be added to the developer housing 75 from a toner supply hopper 80. To discharge toner from the toner supply hopper 80, rotatable toner dispenser 56 is provided at the lower or dispensing end of the toner supply hopper 80, at the inlet to the developer housing 75. Toner supply hopper 80 can be any suitable container for toner that provides toner to a toner dispenser for replenishing the supply of toner in the developer housing.

Preferably, toner dispenser 56 is a foam roll driven by a cam follower 81 integral with lever arm 82. The cam follower 81 pivots about dispenser roll point 84 responsive to the housing drive 78 driving dispenser drive cam 86. As illustrated in FIG. 3, this motion is prevented by the action of pin 88 of interrupt mechanism 90 engaging lever arm 82. To release pin 88 from engagement with lever arm 82, dispenser solenoid 74 is energized to retract interrupt mechanism 90. This disengages pin 88 from engagement with surface 92 of lever arm 82. The energization of dispenser solenoid 74 retracts interrupt mechanism 90 from right to left and thus pin 88 to the position shown in phantom. The retraction of pin 88 releases lever arm 82 for pivoting motion about dispenser roll point 84. The release of lever arm 82 enables cam follower 81 engaging the toner dispenser 56 to move in response to the surface of cam 86. The motion of cam follower 81 rotates the toner dispenser 56 causing toner to be deposited from the supply hopper 80 to the developer housing 75. Preferably, the toner dispenser roll 56 is comprised of a relatively porous sponge-like material and rotates to carry toner particles adhering to the sponge-like material for depositing into the developer housing 75.

In a preferred embodiment, there is a two second copy cycle. The dispenser solenoid 74 is energized a predetermined duty cycle or ratio of the 2 second copy cycle depending upon predetermined successive error signals generated by comparator 68. For example, if the error signal is within a first range, the dispenser solenoid is not activated. If the error signal, however, is within a second predetermined range, the dispenser solenoid is activated for 0.5 seconds for the first error signal. A second successive error signal within the second predetermined range activates the dispenser solenoid for 1.0 seconds, and a third successive error signal within the second predetermined range activates the dispenser solenoid for 1.5 seconds. The longer the dispenser solenoid 74 is activated, the longer the toner dispenser 56 rotates and the more toner particles are conveyed from the toner supply 80 to the developer housing 75.

With reference to FIG. 3, the machine 10 includes a controller logic board 94 supporting the controller 54 with related memory and a driver board 96 electrically connected to the controller logic board 94 and the sensor 58 and generally supporting the circuitry shown in FIG. 4.

The circuitry in FIG. 4 includes comparator 68, digital to analog circuitry 70 with ladder network 72, LED driver 102 and the signal processing circuits 66 comprising sample and hold circuitry 100 and the manual adjust circuitry 104A and 104B.

The control of toner density on the drum surface 13 is based upon the equation $$V_B/V_P=K \quad (1)$$

where $V_B$ equals sensor voltage from a clean drum surface (representing background or reference);

$V_P$ equals sensor voltage from the solid area developed patch sample; and

K equals a constant for a given machine that is manually adjustable and corresponds to the setting of variable voltage divider 106 of manual adjust circuitry 104A as seen in FIG. 4.

The control system for automatic development control (DC) is divided into four interrelated states; namely, the the ADC set up state, the background sample state ($V_B$), the patch sample state ($V_P$) and the dispenser control state.

The ADC set up state is initiated by first setting proper line density for the machine. Proper line density is generally done by a service representative and requires manually operating the toner dispenser while making copies. Once the desired copy line quality is obtained, the machine is put in a diagnostic mode, commonly done by activating a diagnostic switch and inserting a specified diagnostic code at an operators console. With the machine in the diagnostic mode, the next step is for the service representative to make one copy and at that time the digital equivalents of voltages $V_B \times G$ and $V_P \times G$ are automatically obtained by means of the digital to analog converter 70 and stored in a suitable memory location in controller 54. The term G refers to a predetermined gain factor. The explanation of the gain factor G and the obtaining of the digital equivalents will become apparent in the discussion of the background sample state. Once the digital equivalent of voltages $V_B \times G$ and $V_P \times G$ are stored in memory, the controller 54 alternately conveys these two digital values to the ladder network 72 via the eight input lines Bit 0 through Bit 7, at a 60 hertz rate.

In the diagnostic mode, during the period that the quantity $V_B \times G$ is conveyed to the ladder network 72, the DIVD line as seen in FIG. 4*b* is set to switch in variable voltage divider 106 of the manual adjust circuitry 104A. The output of the ladder network 72 is one input to the comparator 68 and also one input to op amp 108 of manual circuitry 104B. The alternating output of the ladder network 72 produces a 60 hertz square wave with the value of one level equal to $(V_B \times G)/(K)$ and the value of the other level equal to $V_P \times G$. These two levels are amplified approximately 1.5 by op amp 108 and then coupled to ground at the terminal ADCTP. Using a test meter connected at terminal ADCTP, the service representative varies the variable voltage divider 106 until the AC signal at the terminal ADCTP becomes zero. With the AC signal at zero, the value K, corresponding to the setting of variable divider 106, has been adjusted such that $$(V_B \times G)/(K)=V_P \times G \quad (2)$$

and the automatic development control system has been set up in accordance with equation (1).

Once voltage divider 106 or K is set, the ADC will operate the toner dispenser 56 in order to make all subsequent values of $V_P \times G$ equal to $(V_B \times G)/(K)$. By controlling the solid area density with respect to the photoreceptor background, effects such as contamination and LED degradation are minimized since control is not dependent upon the absolute value of $V_B$ but rather the ratio of $V_B$ to $V_P$.

In the background sample state, a background sample of drum surface 13 is taken while the machine cycles up for a copy run in response to start print. A pulse from controller 54 activates signal processing circuits 66 and the LED 60 as seen in FIG. 2. In particular, with reference to FIG. 4, the LED pulse activates transistor Q21 of LED driver 102, and also activates CMOS transmission gate 110 of sample and hold circuitry 100. The transistor Q21 is an inverting switch interfacing the controller 54 with the transistor Q20 of LED driver 102. The transistor Q20 is a PNP Darlington power transistor configured as a constant 0.5 amp current source connected to LED 60 at sensor 58 via line LED+. As long as the voltage developed across LED 60 remains between 0 and 3.25 volts, the LED driver 102 will maintain a constant current to LED 60 as determined by the base divider network and emitter resistor of transistor Q20.

When the LED pulse from controller 54 is a logic 1, LED driver 102 is enabled, the transmission gate 110 goes into a low impedance state, and the output voltage of pre-amp 64 of sensor 58 charges capacitor C27 of sample and hold circuitry 100. That is, the voltage output of pre-amp 64 is input to voltage follower buffer 112 at terminal ADCS16 and charges capacitor 127 through transmission gate 110. When the controller 54 resets the LED line to logic 0, the transmission gate 110 returns to its high impedance state and stores the voltage from pre-amp 64 on capacitor C27.

The three gain lines identifed as GAN1, GAN2 and GAN3 of sample and hold circuitry 100 are connected to controller 54. With the three GAN lines at logic 0, the op-amp 114 amplifies the voltage from pre-amp 64 of sensor 58 by a nominal 1.1. As the GAN lines are enabled in a binary fashion (001, 010,—111), the gain of the op-amp 114 is incremented in discrete steps to a maximum of 5.5. This gain previously identified as G is added to the system as required to maintain the output of op-amp 114 at 6 volts or greater in order to minimize digitizing errors of conversion. In other words, the output of the pre-amp 64 of sensor 58 stored at capacitor 27 is maintained at 6 volts or greater for a background or bare drum surface sample.

The output of D/A converter 70 from ladder network 72 is connected to comparator 68. The D/A converter 70 step size is approximately 47 millivolts for a 12 volt supply. That is, for a twelve volt supply, each of the possible 256 combinations of bits at the 8 input lines Bit 0 through Bit 7 from controller 54, there is approximately a 47 millivolt step increase at the output of ladder network 72. The analog output of the ladder network 72 is determined by the controller bits 0 through 7 on lines Bit 0 through Bit 7 according to the equation:

$$V_o = \frac{12}{2^8}\left(1 + \sum_{n=o}^{7} 2^n \cdot S_n\right) \quad (3)$$

Where $S_n$ is the positive logic state (0 or 1) of Bit n.

In response to a start print operation seen in FIG. 5, the controller 54 activates LED driver 102 and sample and hold circuitry 100. After a real time delay of 17 controller instruction cycles (approximately 70 microseconds), LED driver 102 and sample and hold circuitry 100 are turned off. A voltage ($V_B \times 1.1$) appears at the output of op amp 114 of sample and hold circuitry 100. As previously discussed, op amp 114 provides a 1.1 gain of the voltage from pre-amp 164 when three Gan lines GAN1, GAN2, and GAN3 are at logic 0.

The controller 54 then conveys the most significant bit (MSB) on Bit 7 line to the ladder network 72 to present 6 volts to the comparator 68. In other words, logic 1 on the Bit 7 line and logic 0s on all other lines into ladder network 72 produces a 6 volt output from ladder network 72. If the output of the op amp 114 from sample and hold circuitry 100 is less than 6 volts, controller 54 increments the GAN lines in binary increments until either the 6 volt condition is satisfied or the maximum gain, 5.5, is reached. For the remainder of the copy run, this gain setting remains fixed.

Next, the controller 54 performs an analog to digital conversion with D/A circuitry 70 to find the digital equivalent of the analog voltage $V_B \times G$ where G is the gain of the sample and hold circuitry 100 obtained in the previous operation. This is done by continually conveying 8 bit words in a predetermined sequence to the input of ladder network 72. In response, the network 72 produces an incrementing analog signal. When a binary word input to the network 72 has an analog value at the output equivalent to the value $V_B \times G$, that particular binary word is the digital equivalent. It should be noted that the D/A circuitry 70 in this operation, is in fact, being used as an analog to digital converter rather than a digital to analog converter.

The digital equivalent of $V_B \times G$ is then compared against digital equivalents corresponding to 2.2 volts and 9.7 volts to verify the equation:

$$2.2V < V_B \times G < 9.7. \quad (4)$$

The value of $V_B \times G$ within these limits verifies normal ADC system operation.

If the value of $V_B \times G$ is not within these limits, the system enters a "force nominal" condition to bypass the patch sample state and cause the dispensing roll 56 to be activated 0.5 seconds for each 2.0 second copy cycle. In such a condition, the 0.5 seconds generally provides enough toner from the toner dispenser 56 to maintain proper density for a normal area coverage input document. The force nominal condition will be cleared, if at the start of the next copy run, the value of $V_B \times G$ is within the specified limits. If equation (4) is satisfied, the value of $V_B \times G$ is stored in memory in controller 54 to be used in the patch sample state.

It should be noted that in a preferred embodiment, machine 10 includes copy light and copy dark select switches. The force nominal condition can be caused by $V_B \times G$ being outside the limits or by an operator selection of either the copy light or the copy dark switch. The elimination of ADC control in a copy light or copy dark select state is to prevent the ADC control from attempting to correct or change a density condition that is actually desired.

The patch sample state, FIG. 6, is entered once every copy cycle unless a "force nominal" condition exists. In this state, the shutter solenoid 52 is actuated at the end of every scan, in order that the light from the scanning lamp 40 is blocked. The blocking of the light leaves a charged latent patch LP on the drum surface 13 in the interdocument space as seen in FIG. 3. The photoreceptor drum 12 rotates and the patch LP is developed at developer station 19.

During mid-scan of the next copy cycle, the developed patch DP is rotated directly over sensor 58. When the developed patch DP is centered, controller 54 enables LED driver 102 and sample and hold circuitry 100 for 17 controller cycles or approximately 70 microseconds. The value of gain G of the sample and hold circuitry 100, remains the same as the value obtained during the background sample state. At the end of the 70 microsecond period, LED driver 102 and sample and hold circuitry 100 are turned off and the voltage $V_P \times G$ appears at the output of op amp 114 of sample and hold circuitry 100.

The controller 54 then conveys the digital word corresponding to the analog voltage $V_B \times G$ from the memory of controller 54 to the ladder network 72. Simultaneously, the DIVD line, FIG. 5, is enabled. This divides down the analog output of the ladder network 72 by the pre-set value of K as described above in the set up state. Therefore, the voltage $V_B \times G$ divided by K is presented as one input to comparator 68. The other input to the comparator 78 is the voltage $V_P \times G$ from op amp 114. That is, the voltages $V_P \times G$ and $(V_B \times G)/(K)$ are compared. If $(V_B \times G)/(K)$ is smaller indicating solid area density low, an error register in controller 54 is incremented. On the next copy cycle, more toner will be added. If the voltage $(V_B \times G)/(K)$ is larger, indicating sufficient toner, the error register in controller 54 is cleared and the toner dispenser 56 is turned off until a subsequent comparison indicates more toner is required.

In the dispenser control state, with reference to FIG. 7, the information contained in the error register in controller 54 is transferred to a dispenser register in controller 54. This occurs at the start of every scan cycle. The dispenser register contains a number representing the number of previous consecutive copy cycles that the patch sample density voltage $V_P \times G$ has been higher than the reference voltage $(V_B \times G)/(K)$.

Sample patch density represents grams of toner per square centimeter. Therefore, if patch density is low, then $V_P \times G$ is greater than $(V_B \times G)/(K)$. That is, patch voltage $V_P \times G$ is inversely proportional to toner density or developed toner mass.

Depending upon the number in the dispensing register, the toner dispenser 56 is activated at the start of scan for a predetermined number of seconds. In particular, for each time the patch sample voltage $V_P \times G$ has been higher, for successive copies, the toner dispenser 56 is activated as previously discussed in increments of 0.5 seconds up to 1.5 seconds. That is, on the first manifestation that the patch toner density is low, the toner dispenser 56 is activated for 0.5 seconds. If the patch toner density has been determined to be low on two consecutive readings by sensor 58, the toner dispenser 56 is activated for 1.0 seconds, and if the patch density has been determined to be lower for three consecutive copy cycles, the toner dispenser 56 is activated for 1.5 seconds. However, if there are more than three successive measurements of low patch sample toner density, the toner dispenser roll 56 will only be activated for 1.5 seconds.

In other words, the toner dispenser control is copy cycle related in that the toner dispenser 56 is activated for a predetermined fraction of the copy cycle depending upon the type of successive outputs from comparator 68. Stated another way, the toner dispenser control is "off" or "proportionally on" and the amount of toner dispensed is minimized until accumulated error signals indicate a higher toner usage.

While there has been illustrated and described what is at the present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed is:

1. A reproduction machine including
a photoreceptor,
means to form a latent image on the photoreceptor,
a developer for applying toner to the latent image,
a toner dispenser for providing toner to the developer,
a sensor producing a signal representative of developed toner mass,
and a means to activate the toner dispenser for predetermined time periods in response to the sensor signal, the means including a comparator and a digital to analog network, the sensor providing one input to the comparator representing a measurement of the developed toner mass on the photoreceptor and the digital to analog network providing a reference signal representing an undeveloped portion of the photoreceptor.

2. The reproduction machine of claim 1 wherein the activation of the toner dispenser is in incrementing time periods.

3. The reproduction machine of claim 1 wherein the sensor signal represents low toner concentration or high toner concentration and wherein the means to activate the toner dispenser is responsive to successive signals representing low developed toner mass.

4. The reproduction machine of claim 3 wherein the means to activate the toner dispenser is responsive to a first low developed toner mass signal to activate the dispenser for 0.5 seconds, is responsive to two successive low developed toner mass signals to activate the dispenser for 1.0 seconds, and is responsive to three successive low developed toner mass signals to activate the toner dispenser for 1.5 seconds.

5. The reproduction machine of claim 3 having a predetermined copy cycle time and wherein the means to activate the toner dispenser is responsive to the low developed toner mass signal to activate the toner dispenser a portion of the copy cycle time.

6. The method of providing an automatic development control system in a reproduction machine having a photoreceptor, a developer apparatus, the developer apparatus applying toner to the photoreceptor, and a toner dispenser providing toner for the developer apparatus, comprising the steps of
obtaining a reference signal representing an underdeveloped photoreceptor surface
setting gain circuitry to adjust the reference signal to a reference value,
using digital to analog circuitry to provide an analog to digital conversion of the reference value to obtain a digital representation of the reference value,
obtaining a signal representing developed toner mass on the photoreceptor
comparing the digital representation of the reference signal with the signal representing developed toner mass and generating an error signal representing relative low developed toner mass;
analyzing the error signal representing low developed toner mass, and activating the toner dispenser in a predetermined manner to supply toner to the developer apparatus in response to a sequence of low toner concentration signals.

7. The method of claim 6 wherein the reproduction machine has a two second copy cycle and the toner dispenser is activated, 0.5, 1.0, and 1.5 seconds in response to successive error signals representing 1, 2, and 3 successive low signals, respectively.

8. The method of claim 6 wherein the step of comparing includes the steps of converting the digital representation of the reference value through said digital to analog circuitry to its analog equivalent and comparing it with analog signals representing measurements of developed portions of the photoreceptor.

9. The method of claim 6 wherein the step of comparing includes the steps of
obtaining a gain constant G for the automatic development control system,
determining a system adjustment constant K, and
comparing the values $(V_B \times G)/(K)$ and $V_p \times G$ where $V_B$ represents the reference signal and $V_p$ represents the developer toner mass signal.

10. The method of claim 9 wherein the constant K represents the adjustment of a variable voltage divider manually set prior to automatic development control.

11. A toner dispensing device for use in an electrostatic reproduction machine having a developer mechanism for applying toner to exposed images on a photoreceptor producing toner images thereon including
a developer mechanism drive,
a container for toner, the toner dispensing device supplying the developer mechanism with toner,
a toner dispenser drive, an interrupt mechanism inhibiting the toner dispenser drive, means to activate the interrupt mechanism for predetermined time periods for activation of the toner dispenser drive and a follower interconnecting the developer mechanism drive and the toner dispensing device, the interrupt mechanism being connected to the follower in order to prevent motion of the toner dispensing device.

12. The toner dispensing device of claim 11 wherein the toner dispenser drive is the developer mechanism drive.

13. The apparatus of claim 15 including a cam connected to the developer mechanism drive, the interrupt mechanism including a pin, the follower including a first arm coupled to the cam and a second arm engaging the pin to arrest motion of the toner dispensing device, wherein the activation of the interrupt mechanism retracts the pin from engagement with the second arm.

14. The apparatus of claim 11 including a sensor and a control comprising a comparator for producing signals representative of low developed toner mass, the signals discretely activating the interrupt mechanism to allow motion of the toner dispensing device.

* * * * *